US011708740B2

(12) United States Patent
Hallundbæk

(10) Patent No.: US 11,708,740 B2
(45) Date of Patent: Jul. 25, 2023

(54) DOWNHOLE PACKER ASSEMBLY

(71) Applicant: WELLTEC OILFIELD SOLUTIONS AG, Zug (CH)

(72) Inventor: Jørgen Hallundbæk, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 17/514,410

(22) Filed: Oct. 29, 2021

(65) Prior Publication Data

US 2022/0136363 A1 May 5, 2022

(30) Foreign Application Priority Data

Oct. 30, 2020 (EP) ..... 20204922

(51) Int. Cl.
*E21B 33/1295* (2006.01)

(52) U.S. Cl.
CPC ..... *E21B 33/12955* (2013.01)

(58) Field of Classification Search
CPC ..... E21B 43/105; E21B 33/1275; E21B 33/1277; E21B 23/06
See application file for complete search history.

(56) References Cited

U.S. PATENT DOCUMENTS 2,187,635 A * 1/1940 Stamps ..... E21B 33/12 166/151
3,085,627 A * 4/1963 Sodich ..... E21B 33/1208 166/212
3,104,717 A * 9/1963 Adelbert ..... E21B 33/1277 277/334
3,175,618 A * 3/1965 Lang ..... E21B 43/105 166/207
5,242,019 A * 9/1993 Benker ..... E21B 33/1208 166/212

(Continued)

FOREIGN PATENT DOCUMENTS

GB 1458096 12/1976

OTHER PUBLICATIONS

Extended Search Report for EP20204922, dated Mar. 25, 2021, 8 pages.

*Primary Examiner* — Shane Bomar
(74) *Attorney, Agent, or Firm* — Nixon & Vanderhye P.C.

(57) ABSTRACT

The present invention relates to a downhole packer assembly for expansion of a metal sleeve, such as a metal patch, in a well downhole in a well tubular metal structure, comprising a body part and an expandable tubular element surrounding the body part and each end of the expandable tubular element being connected with the body part, providing an expandable space therebetween, the expandable space being fillable with liquid during expansion, the expandable tubular element having an outer face and an inner face, the expandable tubular element comprising an elastomeric or rubber material having a friction coefficient, wherein the expandable tubular element comprises a friction-enhancing material providing a higher friction coefficient of the outer face than the friction coefficient of the elastomeric or rubber material. The invention also relates to a downhole system comprising the downhole packer assembly and a positive displacement pump for expanding the expandable tubular element.

15 Claims, 4 Drawing Sheets

(56) References Cited

U.S. PATENT DOCUMENTS

Figure 1:
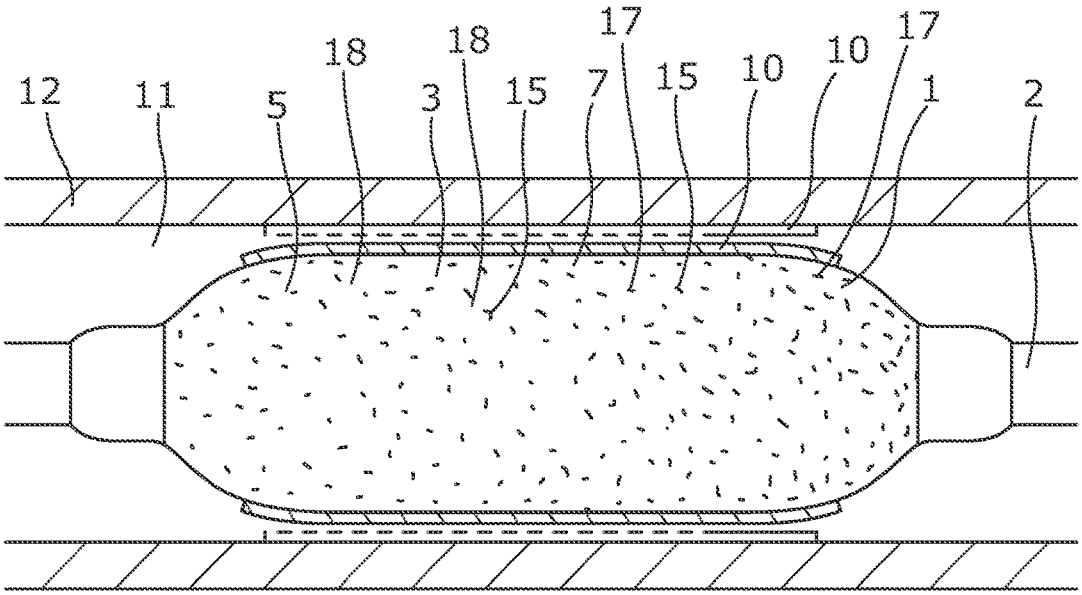

| | | | | |
|---|---|---|---|---|
| 5,404,946 | A * | 4/1995 | Hess | E21B 33/1275 166/325 |
| 5,507,341 | A * | 4/1996 | Eslinger | E21B 33/1277 277/331 |
| 5,613,555 | A * | 3/1997 | Sorem | E21B 33/1277 166/195 |
| 8,894,069 | B2 * | 11/2014 | Xu | E21B 33/1277 277/331 |
| 11,002,098 | B2 * | 5/2021 | Andersen | E21B 29/10 |
| 11,428,066 | B2 * | 8/2022 | Andersen | E21B 33/1275 |
| 11,585,176 | B2 * | 2/2023 | Hitchcock | E21B 43/11 |
| 2003/0196795 | A1 | 10/2003 | Kutac et al. | |
| 2005/0016740 | A1 * | 1/2005 | Aldaz | E21B 43/08 166/387 |
| 2007/0261847 | A1 | 11/2007 | Saltel | |
| 2011/0100641 | A1 * | 5/2011 | Briquet | E21B 49/10 166/373 |
| 2011/0266004 | A1 * | 11/2011 | Hallundbaek | E21B 43/105 166/387 |
| 2013/0220641 | A1 * | 8/2013 | Fripp | E21B 33/13 166/387 |
| 2014/0224511 | A1 * | 8/2014 | Pessin | E21B 43/128 166/387 |
| 2014/0299334 | A1 * | 10/2014 | Hallundbæk | E21B 33/1208 166/387 |
| 2018/0087350 | A1 * | 3/2018 | Sherman | E21B 43/086 |
| 2019/0226299 | A1 | 7/2019 | Andersen | |
| 2022/0134410 | A1 * | 5/2022 | Xu | B21D 41/026 72/476 |

* cited by examiner

DOWNHOLE PACKER ASSEMBLY

This application is claims priority to EP Patent Application No. 20204922.7 filed 30 Oct. 2020, the entire contents of which is hereby incorporated by reference.

The present invention relates to a downhole packer assembly for expansion of a metal sleeve, such as a metal patch, in a well downhole in a well tubular metal structure. The invention also relates to a downhole system comprising the downhole packer assembly and a positive displacement pump for expanding the expandable tubular element.

When expanding a metal patch within a well tubular metal structure which has no leaks or perforations, the liquid between the radially expanding patch and the inner face of the well tubular metal structure may be trapped since the liquid cannot escape through any openings, such as leaks or perforations. Such entrapped liquid in a pocket between the metal patch and the well tubular metal structure hinders full expansion of the patch and thus prevents that the patch can seal properly against the inner face of the well tubular metal structure.

It is an object of the present invention to wholly or partly overcome the above disadvantages and drawbacks of the prior art. More specifically, it is an object to provide an improved downhole packer assembly for expanding a metal patch within a well tubular metal structure without entrapping liquid in a pocket between the metal patch and the well tubular metal structure, hindering full expansion of the metal patch.

The above objects, together with numerous other objects, advantages and features, which will become evident from the below description, are accomplished by a solution in accordance with the present invention by a downhole packer assembly for expansion of a metal sleeve, such as a metal patch, in a well downhole in a well tubular metal structure, comprising:

a body part, and an expandable tubular element surrounding the body part and each end of the expandable tubular element being connected with the body part, providing an expandable space therebetween, the expandable space being fillable with liquid during expansion, the expandable tubular element having an outer face and an inner face, the expandable tubular element comprising an elastomeric or rubber material having a friction coefficient, wherein the expandable tubular element comprises a friction-enhancing material providing a higher friction coefficient of the outer face than the friction coefficient of the elastomeric or rubber material.

Moreover, the expandable tubular element may be made of elastomer or rubber and is an expandable elastomeric or rubber tubular element.

Further, the friction-enhancing material may be grains, such as individual grains.

Furthermore, the grains may form an outermost part or layer of the expandable tubular element, the outermost part or layer facing away from the body part.

Additionally, the expandable tubular element may have a first thickness, the outermost part or layer having a second thickness of 5-25% of the first thickness, preferably 5-20%, 5-25% of the first thickness, more preferably 10-20% of the first thickness, and even more preferably 10-15% of the first thickness.

Further, the downhole packer assembly may be coverless, i.e. the downhole packer assembly having a cover which is to be removed before use.

In addition, the friction-enhancing material may not be a mechanical reinforcement of the expandable tubular element itself.

In addition, the grains may be embedded in an outer material face of the elastomeric or rubber material of the expandable tubular element, the outer material face forming the outer face of the expandable tubular element.

By having grains embedded in an outermost part of the expandable tubular element, a simple friction enhancement is provided which is ready to use without a protective cover or other means nor that any actions prior to running the downhole packer assembly into hole.

Thus, the embedded grains do not easily fall off and does not need extra protection while still being able to provide the increased friction to the rubber or elastomeric material.

Furthermore, some of the grains may provide a projection radially outwards away from the body.

Additionally, each of some of the grains may provide a local projection radially outwards away from the body.

Also, the grains may be adhered to the outer face of the expandable tubular element.

Furthermore, the friction-enhancing material may be a friction-enhancing layer.

Moreover, the friction-enhancing layer may be an adhesive or paint.

Further, the friction-enhancing layer may comprise a mixture of grains and an adhesive or a paint.

In addition, the friction-enhancing layer may be applied on the outer face of the expandable tubular element.

Also, the body part may have an opening for providing fluid communication to the expandable space in order to expand the expandable tubular element.

Furthermore, the grains may be made of silicon dioxide ($SiO_2$), zirconium silicate ($ZrSiO_4$), aluminium oxide ($Al_2O_3$), cubic boron nitride (cBN) or metal alloy.

Moreover, the grains may comprise ceramics.

Also, the expandable tubular element may comprise metal enhancement, such as metal strips, metal lamellas or slats, a weave or mesh structure, or a metal grid.

Further, the expandable tubular element may comprise metal enhancement, such as strips, slats, lamellas, a weave or mesh structure, or a grid, where the strips, slats, lamellas, a weave or mesh structure, or a grid are made of metal, a composite, fibre material, etc.

In addition, the metal strips, metal lamellas or metal slats may extend axially along the body part or circumferentially around the body part.

Also, the expandable tubular element may comprise a packer-reinforcement layer having at least one fibre layer, a wire, a cable, a nanofibre, a nanotube and/or a nanoparticle-modified elastomer.

Furthermore, the metal strips, metal lamellas or slats, a weave or mesh structure, or a metal grid may be embedded in the elastomeric or rubber material.

Moreover, the packer may comprise metal coil springs arranged in grooves of the outer face.

Further, the downhole packer assembly may be an inflatable packer being constructed with a packer-reinforcement layer having at least one fibre layer. The fibre layers may provide both mechanical and anti-extrusion properties in a relatively simple and small package.

In addition, the invention relates to a downhole system comprising the above downhole packer assembly and a positive displacement pump for expanding the expandable tubular element.

Also, the downhole system may comprise at least one metal sleeve arranged around the expandable tubular element.

Furthermore, the downhole system may comprise a driving unit, such as an electric motor, for driving the pump.

Finally, the downhole system may comprise a downhole tractor for propelling the downhole system forward in the well.

By "grain" is meant any physical particle or small entity. By "grains" is thus meant granules or individual particles.

Figure 2:
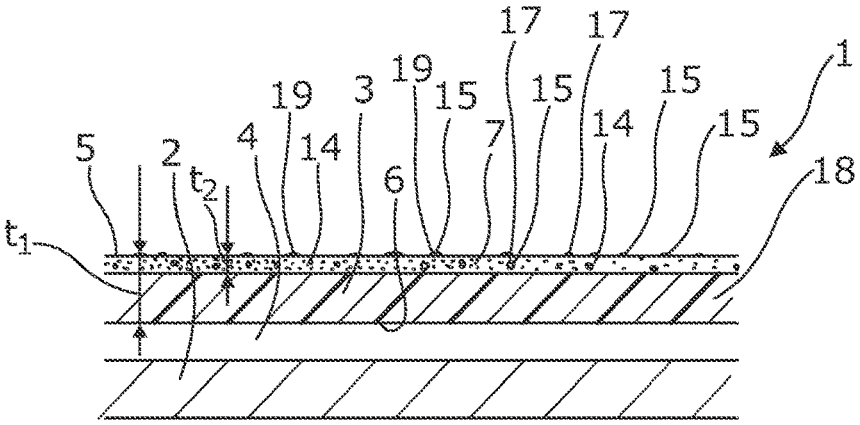
Figure 3:
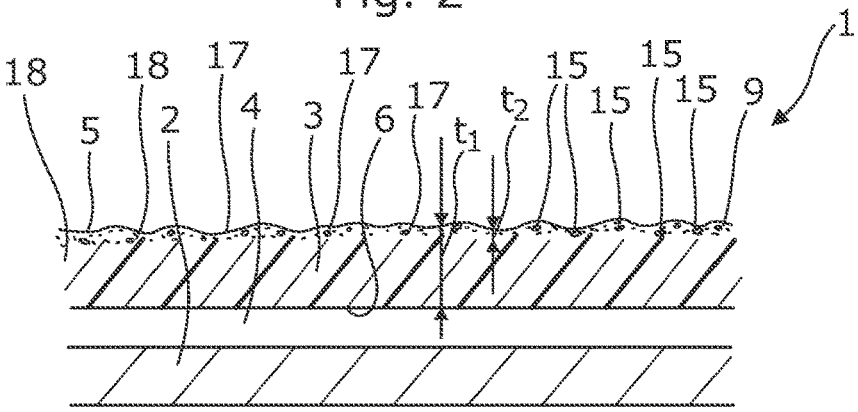
Figure 4:
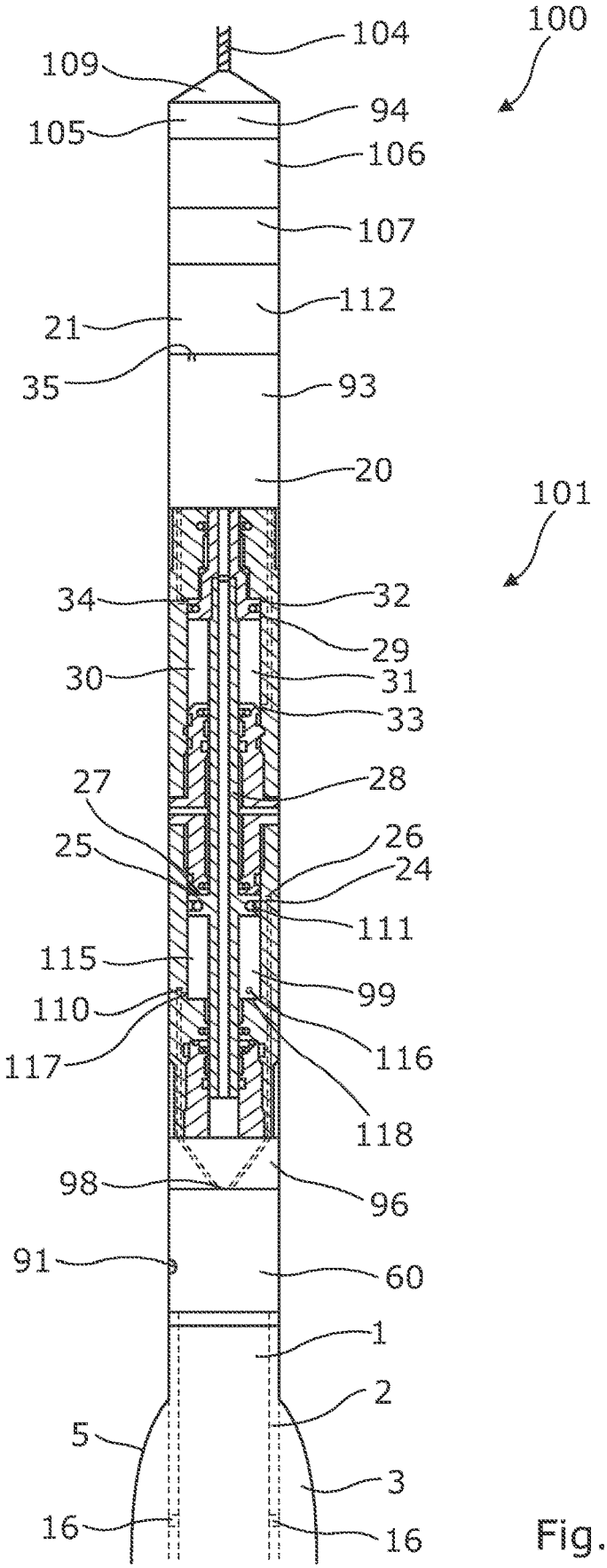
Figure 5:
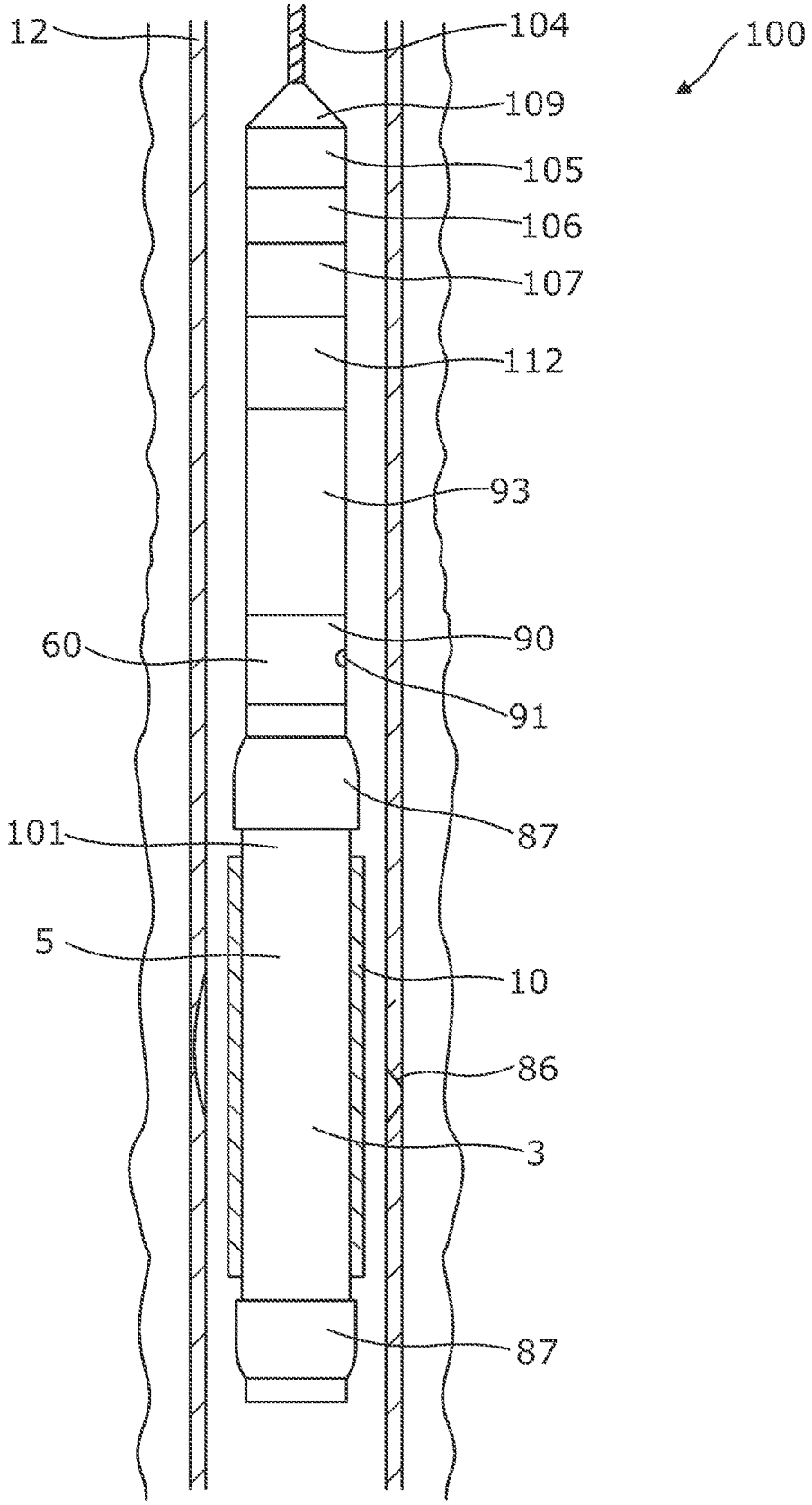
Figure 6:
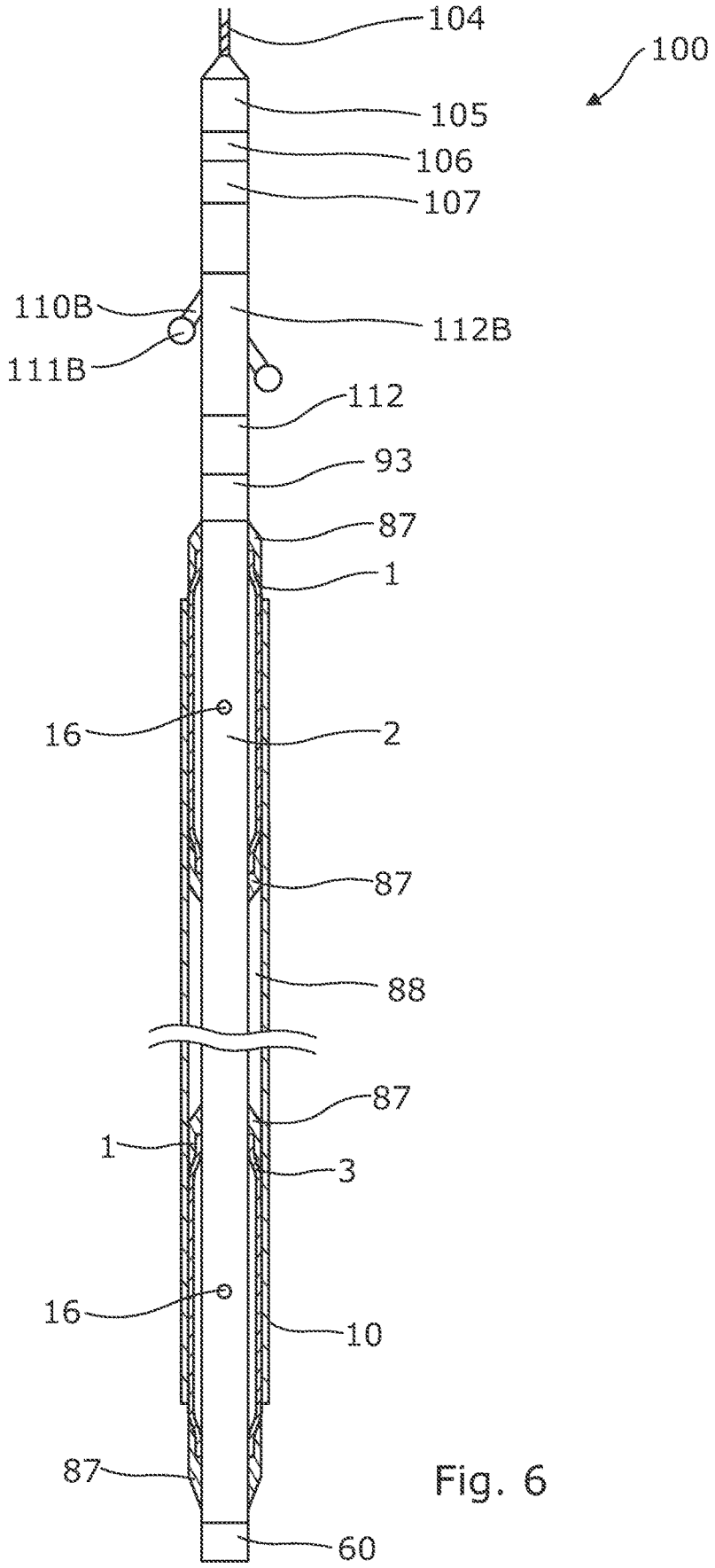

The invention and its many advantages will be described in more detail below with reference to the accompanying schematic drawings, which for the purpose of illustration show some non-limiting embodiments and in which:

FIG. 1 shows a downhole packer assembly partly expanded with a metal patch in a well tubular metal structure, FIG. 2 shows a partly cross-sectional view of a part of a downhole packer assembly, FIG. 3 shows a partly cross-sectional view of a part of another downhole packer assembly, FIG. 4 shows a partly cross-sectional view of a downhole system having a downhole packer assembly and a displacement pump, FIG. 5 shows a partly cross-sectional view of another downhole system, and FIG. 6 shows a partly cross-sectional view of another downhole system having two downhole packer assemblies and a tractor unit.

All the figures are highly schematic and not necessarily to scale, and they show only those parts which are necessary in order to elucidate the invention, other parts being omitted or merely suggested.

FIG. 1 shows a downhole packer assembly 1 for expansion of a metal sleeve, such as a metal patch 10, in a well 11 downhole in a well tubular metal structure 12. The downhole packer assembly 1 comprises a body part 2 surrounded by an expandable tubular element 3 having two ends being connected with the body part 2, providing an expandable space 4 (shown in FIG. 2) therebetween. In order to expand the expandable tubular element 3 to expand the metal patch 10, the expandable space 4 is fillable with liquid during such expansion. The expandable tubular element 3 has an outer face 5 and an inner face 6 shown in FIG. 2. The expandable tubular element 3 comprises an elastomeric or rubber material 18 having a friction coefficient, and the expandable tubular element 3 comprises a friction-enhancing material 17 providing a higher friction coefficient of the outer face than the friction coefficient of the elastomeric or rubber material 18. The elastomeric or rubber material has a friction coefficient, $\mu=F/N$, N being the normal force perpendicular to the interface between two sliding surfaces. The friction coefficient may be measured according to the standard ASTM G115—10 (2018) "Standard Guide for Measuring and Reporting Friction Coefficients".

The downhole packer assembly 1 is arranged inside the metal patch/sleeve 10 to be expanded so that the metal patch 10 surrounds the expandable tubular element 3 and so that the metal patch 10 expands as the expandable tubular element 3 expands. The metal patch 10 is shown in a cross-sectional view in both FIGS. 1 and 5 to illustrate that the metal patch 10 encloses the packer assembly 1 and expands as the expandable tubular element 3 expands. In FIG. 1, the expandable tubular element 3 is shown in a partly expanded condition, and the dotted line is to illustrate the position of the fully expanded metal patch 10. In FIG. 5, the expandable tubular element 3 is shown in an unexpanded condition.

By increasing the friction on the outer face of the expandable tubular element 3, the metal patch 10 is expanded more equally, and no pockets are formed between the inner face of the well tubular metal structure 12 and the outer face of the metal patch 10. This is due to the fact that the pointwise expansion of the metal patch 10 is controlled so that no area point is expanded substantially more than another area point of the metal patch 10. The friction between the metal patch 10 and the expandable tubular element 3 ensures that one area point of the metal patch cannot be expanded more than another area point as compared to when less friction is present because in that case the metal patch 10 can freely expand more in some areas than in others, which creates cracks as the metal patch 10 is thinned too much in these freely expanded areas. The higher friction between the outer face of the expandable tubular element 3 and the inner face of the metal patch 10 limits free expansion and limits the possibility of some areas thinning more than others.

As shown in FIG. 4, the body part 2 of the downhole packer assembly 1 has an opening 16 for providing fluid communication to the expandable space 4 in order to expand the expandable tubular element 3. The downhole system 100 comprising the downhole packer assembly 1 also comprises a positive displacement pump 101 for pumping liquid into the expandable space 4 to expand the expandable tubular element 3. The downhole positive displacement pump 1 comprises a housing 3 having a first end 94 closest to a top of the well and a second end 96 facing opposite the first end 94, i.e. facing down the well. The positive displacement pump 101 is connected to the top via a wireline 104 and a cable head 109. The positive displacement pump 101 comprises an electrical control 105. The positive displacement pump 101 comprises a motor 106 driving the second pump 21. The positive displacement pump 101 further comprises a compensator 107 for keeping a predetermined overpressure in the positive displacement pump 101 compared to the surrounding pressure. The positive displacement pump 101 further comprises a first chamber 99 arranged in the housing 93, and the first chamber 99 has a first outlet 110 in fluid communication with the pump outlet 98 for delivering the increased pressure in a confined space 88 downhole. A first piston 111 is movable in the first chamber 99 for pressing fluid out of the pump outlet 98, and a driving means 112 is configured to drive the first piston 111 in a reciprocating movement in a first direction or an opposite second direction in the first chamber 99. The first piston 111 divides the first chamber 99 into a first chamber part and a second chamber part 115. The first chamber part comprises the first outlet 110 and a first inlet 116. A first valve 117 is arranged in the first outlet 110 for allowing fluid to flow out of the first chamber part and preventing fluid from flowing into the first chamber part, and a second valve 118 is arranged in the first inlet 116 for allowing fluid to flow into the first chamber part and preventing fluid from flowing out of the first chamber part. The positive displacement pump 101 further comprises a control unit 20 for controlling an output of the driving means 112 to the movement of the first piston 111 in the first direction or the second direction. The positive displacement pump 101 may be a single-acting or, as shown in FIG. 4, a double-acting downhole positive displacement pump. In FIG. 4, the driving means 112 is a second pump 21, and in order to drive the first piston 111, the first piston is connected to a piston rod 28, and a second piston 29 is connected to another part of the piston rod 28, and the second pump 21 pumps fluid into a second chamber 30 in which the second piston 29 is movable in the first direction and the opposite second direction. As the second piston 29 moves in the second chamber 30, it moves the first piston 111 back and forth, and in this way liquid is pumped into e.g. the expandable tubular element 3 of the packer assembly 1 to inflate the expandable tubular element 3. The second piston 29 divides the second chamber 30 into a first chamber part 31 and a second chamber part 32, and the first chamber part 31 comprises a first aperture 33, and the second chamber part 32 comprises a second aperture 34. The second pump 21 has a discharge opening 35 fluidly connected with the first aperture 33 in a first position and fluidly connected with the second aperture 34 in a second position via the control unit 20 being a flow control unit. The control unit 20 directs the fluid from the discharge opening 35 to either the first aperture 33 or the second aperture 34 for moving the second piston 29 in the second chamber 30 in the first direction or the second direction, respectively. The second pump 21 thus merely pumps fluid into the control unit 20, and the control unit 20 directs the fluid into the first chamber part 31 of the second chamber 30 to drive the first piston 11 away from the pump outlet 8 and into the second chamber part 32 of the second chamber 30 to drive the first piston 111 towards the pump outlet 98. The fluid in the first chamber 99 is well fluid, and the fluid in the second chamber 30 is tool fluid only flowing in the pump.

In FIG. 4, the downhole positive displacement pump 101 is a downhole double-acting positive displacement pump, where the second chamber part 115 comprises a second outlet 24 in fluid communication with the pump outlet 8 and a second inlet 25. A third valve 26 is arranged in the second outlet 24 for allowing fluid to flow out of the second chamber part 115 and preventing fluid from flowing into the second chamber part 115. A fourth valve 27 is arranged in the second inlet 25 for allowing fluid to flow into the second chamber part 115 and preventing fluid from flowing out of the second chamber part 115. The second outlet 24 and the second inlet 25 are arranged in the part of the second chamber part 115 closest to the top of the well. In the downhole double-acting positive displacement pump, the first piston 11, when moving in one direction, is able to suck fluid into the first chamber part while pressing fluid in the second chamber part 115 out of the second outlet 24 and further out of the pump outlet 8, and when moving in the opposite direction the first piston 11 is able to suck fluid into the second chamber part 115 while pressing fluid in the first chamber part out of the first outlet 110 and further out of the pump outlet 8. Thus, the pump is a downhole double-acting positive displacement pump using both an upstroke and a downstroke for providing fluid out of the pump outlet, and the pump is thus more efficient than a single-acting downhole positive displacement pump.

The second pump 21 is thus a feed pump. In another embodiment, the driving means 112 may be a drill pipe or drill string for supplying pressurised fluid from the surface to drive the piston back and forth in the chamber.

In FIG. 5, the positive displacement pump 101 further comprises a discharge control unit 60 for discharging fluid in the expandable tubular element 3 of the packer assembly 1 in order to deflate the expandable tubular element 3. The packer assembly 1 is shown in its deflated position. The discharge control unit 90 may be a flow-operated discharge control unit 90. In another embodiment, the discharge control unit 90 comprises an electrically operated valve, which is operated through an electrical conductor passing through the housing to open a discharge outlet 91 of fluid in the packer out into the well in order to deflate the expandable tubular element 3 of the packer assembly 1. The metal patch 10 is expanded for sealing off an opening/leak 86, shown in FIG. 5, in the well tubular metal structure 12. The expandable tubular element 3 of the packer assembly 1 is connected to the body part 2 by connecting sleeves 87.

The expandable tubular element 3 shown in FIG. 1 is made of elastomer or rubber and is an expandable elastomeric or rubber tubular element. The friction-enhancing material 17 is grains 15, such as individual grains, and the expandable tubular element 3 is made of elastomer or rubber 18. The grains 15 are adhered to the outer face of the expandable tubular element 3.

In FIG. 2, the friction-enhancing material is a friction-enhancing layer 7, and the friction-enhancing layer 7 is an adhesive 14 or a paint. In FIG. 2, the friction-enhancing layer 7 comprises a mixture of grains 15 and an adhesive 14 or paint and is an additional layer on the outer material face of the elastomeric or rubber material of the expandable tubular element 3. The grains may be applied as individual particles in a paint, glue or other type of adhesive, or the grains may be applied after the adhesive is applied on the outer material face of the elastomeric or rubber material of the expandable tubular element 3.

In FIG. 3, the grains are embedded in an outer material face of the elastomeric or rubber material of the expandable tubular element 3, and the outer material face forms the outer face of the expandable tubular element 3. Thus, the friction-enhancing layer 7 is applied on the outer face of the expandable elastomeric or rubber material 18 of the expandable tubular element 3.

In FIG. 3, the grains form an outermost part 9 of the expandable tubular element, and in FIG. 2, the grains form an outermost layer 7 of the expandable tubular element. The outermost part or layer facing away from the body part 2. The expandable tubular element 3 has a first thickness $t_1$, and the outermost part or layer has a second thickness $t_2$ of 5-25% of the first thickness, preferably 5-20%, 5-25% of the first thickness, more preferably 10-20% of the first thickness, and even more preferably 10-15% of the first thickness. The downhole packer assembly is coverless, i.e. the downhole packer assembly does not have a cover which is to be removed before use.

By having grains embedded in an outermost part of the expandable tubular element, a simple friction enhancement is provided which is ready to use without a protective cover or other means or without any actions prior to running the downhole packer assembly into hole. Thus, the embedded grains do not easily fall off and do not need extra protection while still being able to provide the increased friction to the rubber or elastomeric material.

In FIG. 2, some of the grains may provide a projection 19 radially outwards away from the body. Thus, each of some of the grains may provide a local projection 19 radially outwards away from the body. In FIG. 3, the embedded grains also provide projections in form of an uneven surface.

The grains may be made of silicon dioxide ($SiO_2$), zirconium silicate ($ZrSiO_4$), aluminium oxide ($Al_2O_3$), cubic boron nitride (cBN), ceramic or metal alloy. Thus, the grains may be sand particles. By "grain" is meant any physical particle or small entity. By "grains" is thus meant granule/granules or individual particles.

The expandable tubular element 3 may comprise metal enhancement, such as metal strips, metal lamellas, metal slats, a weave or mesh structure, or a metal grid. The metal strips, metal lamellas or metal slats extend axially along the body part 2 or circumferentially around the body part 2 so as to be able to expand with the expandable tubular element 3 and deflate again after expanding the metal patch 10. The metal strips, metal lamellas, metal slats, weave or mesh structure, or metal grid may be embedded in the elastomeric or rubber material or added as an additional layer. The expandable tubular element 3 may also comprise a packer-reinforcement layer having fibres, a wire, a cable, a nanofibre, a nanotube and/or a nanoparticle-modified elastomer. The packer further comprises metal coil springs arranged in grooves of the outer face.

In FIG. 6, the downhole system 100 comprises two packer assemblies 1 mounted with a tool part having an opening between them, and a metal patch 10 is arranged in an overlapping manner with the packers forming a confined space 88, which is pressurised together with the packer assemblies 1 to expand the patch by letting liquid out through the openings 16 and also into the confined space 88 between the packer assemblies 1 and the metal patch 10. In this way, a longer metal patch can be expanded than by means of one packer assembly.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular part defining an annular barrier space.

By "casing" or "well tubular metal structure" is meant any kind of pipe, tubing, tubular, liner, string, etc., used downhole in relation to oil or natural gas production.

In the event that the tool is not submersible all the way into the casing, a downhole tractor 112B as shown in FIG. 6 can be used to push the tool/downhole system all the way into position in the well. The downhole tractor 112B may have projectable arms 110B having wheels 111B, wherein the wheels 111B contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole packer assembly for expansion of a metal patch in a well downhole in a well tubular metal structure, the downhole packer assembly comprising:

a body part, and an expandable tubular element surrounding the body part and each end of the expandable tubular element being connected with the body part, providing an expandable space therebetween, the expandable space being fillable with liquid during expansion, the expandable tubular element having an outer face and an inner face, the expandable tubular element comprising an elastomeric or rubber material having a friction coefficient, wherein the expandable tubular element comprises a friction-enhancing material providing a higher friction coefficient of the outer face than the friction coefficient of the elastomeric or rubber material, and wherein the downhole packer assembly further comprises the metal patch, releasably attached with the expandable tubular element, the metal patch having an outer face to engage and seal with the well tubular metal structure and an inner face releasably engaged with the friction enhancing material on the outer face of the expandable tubular element.

2. A packer according to claim 1, wherein the friction-enhancing material comprises grains.

3. A packer according to claim 2, wherein the grains are embedded in an outer material face of the elastomeric or rubber material of the expandable tubular element, the outer material face forming the outer face of the expandable tubular element.

4. A downhole packer assembly according to claim 2, wherein the grains are adhered to the outer face of the expandable tubular element.

5. A downhole packer assembly according to claim 1, wherein the friction-enhancing material is a friction-enhancing layer.

6. A downhole packer assembly according to claim 5, wherein the friction-enhancing layer is an adhesive or a paint.

7. A downhole packer assembly according to claim 5, wherein the friction-enhancing layer comprises a mixture of grains and an adhesive or a paint.

8. A downhole packer assembly according to claim 5, wherein the friction-enhancing layer is applied on the outer face of the expandable tubular element.

9. A downhole packer assembly according to claim 1, wherein the body part has an opening for providing fluid communication to the expandable space in order to expand the expandable tubular element.

10. A downhole packer assembly according to claim 2, wherein the grains are made of silicon dioxide ($SiO_2$), zirconium silicate ($ZrSiO_4$), aluminium oxide ($Al_2O_3$), cubic boron nitride (cBN) or metal alloy.

11. A downhole packer assembly according to claim 1, wherein the expandable tubular element comprises metal strips, metal lamellas or slats, a weave or mesh structure, or a metal grid.

12. A downhole packer assembly according to claim 11, wherein the metal strips, metal lamellas or metal slats extend axially along the body part or circumferentially around the body part.

13. A downhole packer assembly according to claim 1, wherein the expandable tubular element comprises a packer-reinforcement layer having at least one fibre layer, a wire, a cable, a nanofibre, a nanotube and/or a nanoparticle-modified elastomer.

14. A downhole system comprising the downhole packer assembly according to claim 1, and a positive displacement pump for expanding the expandable tubular element.

15. A packer according to claim 1, wherein the metal patch is configured to be 1) carried by the expandable tubular element during run-in, 2) expandable into engagement with the well tubular metal structure due to expansion of the tubular element and 3) released from the tubular element and sealed to the well tubular metal structure when the tubular element is deflated.

* * * * *